US006155516A

United States Patent [19]

Lehrieder et al.

[11] Patent Number: 6,155,516

[45] Date of Patent: Dec. 5, 2000

[54] METHOD FOR TRANSPORTING ROLLS TO A ROLL CHANGER

[75] Inventors: Erwin Paul Josef Lehrieder, Gaukönigshofen; Klaus Walter Röder; Hartwig Horst Trutschel, both of Würzburg, all of Germany

[73] Assignee: Koenig & Bauer Aktiengesellschaft, Wurzburg, Germany

[21] Appl. No.: 09/147,835

[22] PCT Filed: Sep. 11, 1997

[86] PCT No.: PCT/DE97/02026

§ 371 Date: Mar. 16, 1999

§ 102(e) Date: Mar. 16, 1999

[87] PCT Pub. No.: WO98/12131

PCT Pub. Date: Mar. 26, 1998

[30] Foreign Application Priority Data

Sep. 16, 1996 [DE] Germany ..... 196 37 772

[51] Int. Cl.[7] ..... B65H 19/00

[52] U.S. Cl. ..... 242/559.3; 242/559.4; 414/911

[58] Field of Search ..... 242/559, 559.1, 242/559.2, 559.3, 559.4, 560; 414/911

[56] References Cited

U.S. PATENT DOCUMENTS

| | | | |
|---|---|---|---|
| 3,695,539 | 10/1972 | Lindstaedt | 242/559.1 X |
| 4,708,300 | 11/1987 | Goetz | 242/559.1 |
| 4,863,335 | 9/1989 | Herigstad et al. . | |
| 4,948,060 | 8/1990 | Kurz et al. . | |
| 5,076,751 | 12/1991 | Kafka . | |
| 5,085,377 | 2/1992 | Rohrer et al. . | |
| 5,286,157 | 2/1994 | Vainio et al. . | |
| 5,388,955 | 2/1995 | Schroder . | |
| 5,755,395 | 5/1998 | Gnan | 242/559.1 |
| 5,799,897 | 9/1998 | Honegger | 242/559 X |

FOREIGN PATENT DOCUMENTS

| | | | |
|---|---|---|---|
| 0334366 | 9/1989 | European Pat. Off. . | |
| 3627454 | 3/1987 | Germany . | |
| 3910444 | 10/1990 | Germany . | |
| 04064557 | 2/1992 | Japan . | |
| 63-074852 | 4/1998 | Japan . | |
| 2 185 467 | 7/1987 | United Kingdom | 242/559.1 |

*Primary Examiner*—Donald P. Walsh
*Assistant Examiner*—William A. Rivera
*Attorney, Agent, or Firm*—Jones, Tullar & Cooper PC

[57] ABSTRACT

An intermediate storage facility receives rolls on transport cars. The rolls have previously been prepared, by the application of an adhesive, at a roll preparation station. The prepared rolls, each on its individual transport car, are placed in the intermediate storage facility prior to being withdrawn from the intermediate storage facility for use in a roll changer of a web-fed rotary printing press. The intermediate storage facility is situated before, in the direction of roll transport travel, the roll changer, and after the roll preparation station.

2 Claims, 4 Drawing Sheets

METHOD FOR TRANSPORTING ROLLS TO A ROLL CHANGER

FIELD OF THE INVENTION

The present invention relates to a method for transporting rolls to a roll changer by using transport cars. Rolls prepared with adhesive are loaded onto the transport cars which are then held in an intermediate storage facility.

1. Description of the Prior Art

A method for transporting rolls to a roll changer is known from DE 36 27 454 A1. Here, a roll provided with adhesive means is loaded directly on a transport car which carries this prepared roll until this roll has been placed on clamping cones of the roll changer.

DE 39 10 444 A1 describes an installation for the supply of rolls to roll changers and for removal therefrom, with the installation having a temporary storage. Each one of these roll changers has its own gluing station assigned to it.

It is disadvantageous here that a large number of gluing stations are required.

EPO 0334366A2 describes an installation for transporting paper rolls to a printing press by means of "electrically" guided transport cars.

2. Summary of the Invention

The present invention is directed to a method for transporting rolls to a roll changer.

In accordance with the present invention, this object is attained by providing a plurality of roll transport cars. Each roll is prepared at a preparation station and is then placed back onto its transport car. A plurality of these transport cars, carrying prepared rolls, are held in an intermediate storage facility that is located between the preparation station and the roll changer to which the rolls, on their transport cars, will be delivered.

The advantages which can be achieved by means of the present invention reside in particular in that a prepared roll, which has been provided with adhesive means, remains, without being transferred, on a transport car assigned to it from a preparation station to a roll changer. In this way, damage to the prepared roll is prevented and troubles during roll changes are reduced. It is advantageous that a plurality of prepared rolls, each provided with adhesive means, are stored in a temporary storage facility, so that a preparation station can be assigned to several roll changers.

Different prepared rolls, for example, rolls with different widths, can be stored in this storage facility on assigned, separate tracks and can then be selectively removed.

The flexibility of the roll changer is increased in this way, while simultaneously reducing the number of preparation stations.

BRIEF DESCRIPTION OF THE DRAWINGS

The installation for transporting roll in accordance with the present invention is represented in the drawings and will be described in greater detail in what follows.

Shown are in.

DESCRIPTION OF THE PREFERRED EMBODIMENT

Figure 1:
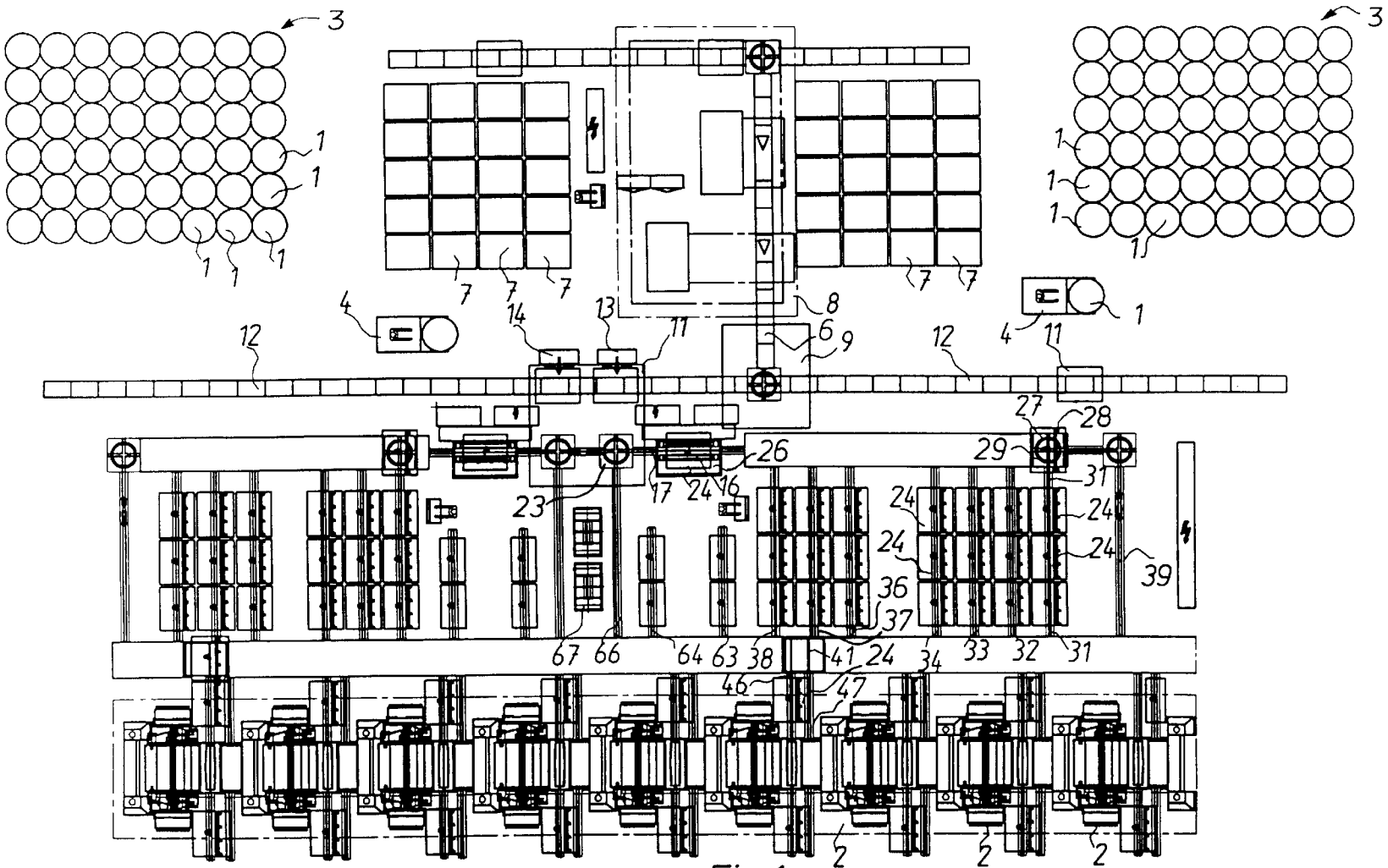
FIG. 1, a schematic representation of an installation for the transportation of rolls.

An installation for the automatic transport of upright rolls 1 from a storage facility 3 to a roll changer 2 of a rotary printing press is constructed as follows:

The upright rolls 1 are transported from a storage facility 3 for a month's supply by a clamping forklift 4 to a roller surface, not represented, and are deposited thereon horizontally (i.e. with a longitudinal axis of the horizontal roll 7 approximately horizontal). The rolls 7 are brought to a first slat conveyor 6 by this roller surface. This slat conveyor 6 transports the horizontal rolls 7 to a first unpacking station 8, by means of which the front covers of the rolls 7 are removed. The first slat conveyor 6 conveys the rolls 7 from this first unpacking station 8 to a second unpacking station 9. This second unpacking station 9 removes a circumferential packaging of the rolls 7 and pivots these horizontal rolls 11 by 90° in a horizontally located plane. These pivoted horizontal rolls 11 are deposited on a second slat conveyor 12 extending parallel in relation to the transport direction of the web-fed rotary printing press and are transported, lying horizontally with their longitudinal axes in the longitudinal direction of the web-fed rotary printing press, to two transfer stations 13, 14.

A portion of the installation for transporting the pivoted horizontal rolls 11, which is located between the transfer stations 13, 14 and the roll changers 2 of the web-fed rotary printing, press, is symmetrically constructed in the present exemplary embodiment, so that for the sake of simplicity only the right half will be described in what follows.

Figure 2:
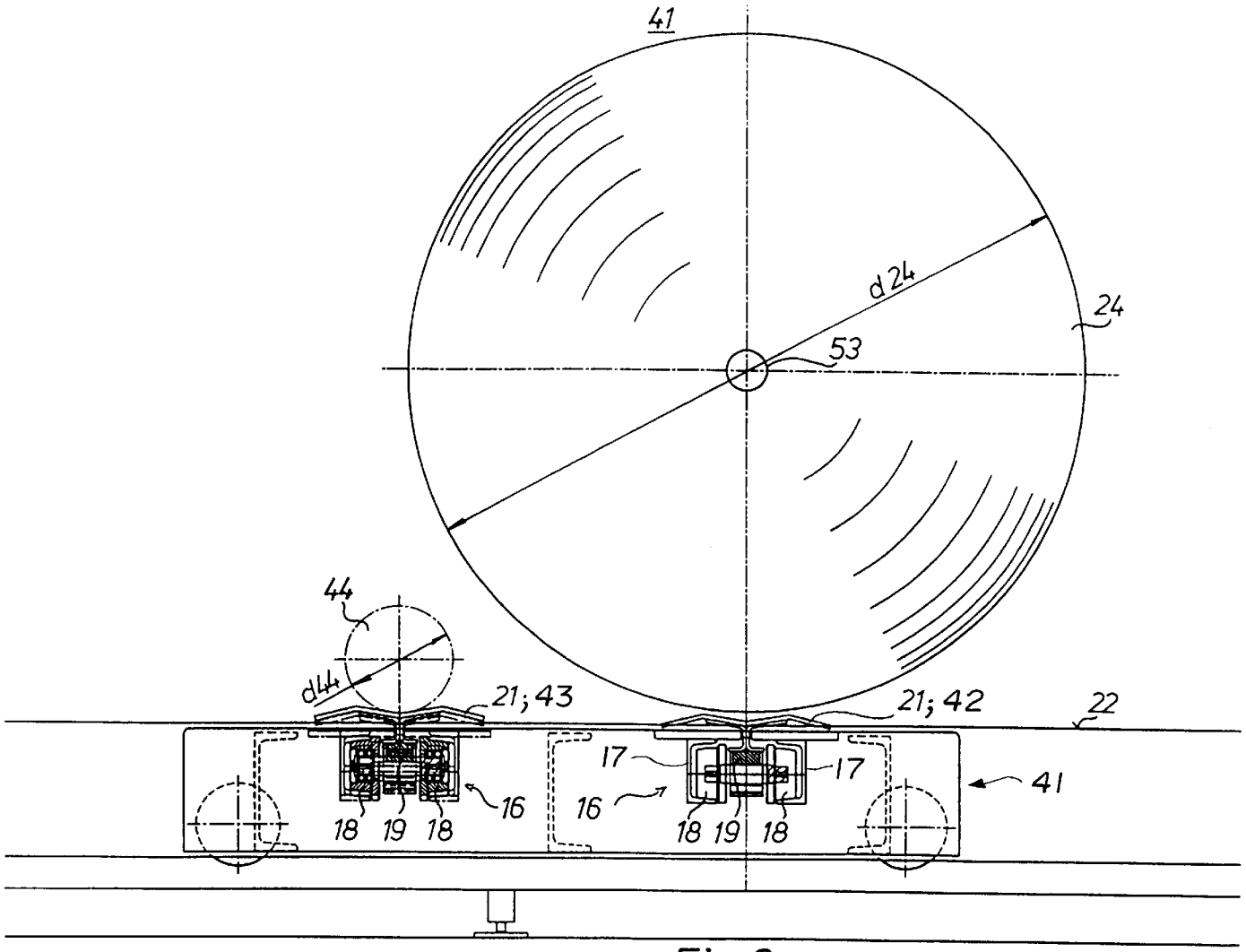
FIG. 2, a schematic lateral view of a transport car with two receivers.

The transfer station 13 pushes the rolls 11 onto a first transport car 16. Such transport cars 16, which are known per se, are guided on rails, for example. In this case, the transport car 16 has four rollers 18, which roll on a pair of rails 17 as seen in FIG. 2. A single rail can also be provided in place of one of a pair of rails 17. The term "tracks", which is used in what follows, includes both a single rail and several, parallel extending rails. A drag chain conveyor, extending inder the floor, is used for moving this transport car 16, for example, and in the present case is designed as a rotating chain. The transport car 16 is connected with this chain at least at times. A trough-shaped basin, or receiver 21, for example, has been attached to a frame 19 of the transport car 16 for receiving the roll 11. This receiver 21 embodied as a basin projects out of a floor 22 of the storage facility, while the transport car 16 runs embedded to a large extent in the floor 22 of the storage facility.

In the preferred embodiment, during the transfer of the rolls 11 from the slat conveyor 12 to the transport car 16, the transport car 16 stands on a turntable 23, which is rotatable by at least 90°, and preferably by 360°. This turntable 23 is provided with guides, which cross each other at 90°, for example rail sections for receiving the transport car 16. After the transport car 16 has been loaded with the loaded roll 24, the transport car 16 with the loaded roll 24 is transported to a preparation station 26, all as seen in FIG. 1. In this preparation station 26 the loaded roll 24 is lifted by two pick-up rollers extending parallel with the longitudinal axis of the roll 24, and a start of the roll 24 is prepared for a roll change with adhesive strips and reflector strips in a generally known manner.

After this adhesive preparation, the now prepared roll 24 is lowered onto the waiting transport car 16. This transport car 16, now loaded with a prepared roll 24, that has been prepared for a roll change, is loaded onto a second transport car 27. This second transport car 27 is also provided with rollers guided on rails and extending, for example, on the bottom in the longitudinal direction of the web-fed rotary printing press. A turntable 28 with at least one receiver 29, for example a section of rail, has been attached to this second transport car 27. Also, and as represented in the example, crossing receivers 29, for example sections of rail, are possible. The second transport car 27 is moved to a selected track 31 of an intermediate storage facility 39, which is designed as a daily storage and has a plurality oftracks 31, 32, 33, 34, 36, 37, 38. On the way from the preparation station 26 to the selected track 31 of the intermediate storage facility 39, the loaded transport car 27 with the prepared roll 24 is turned by 90° in the direction of the selected track 31 by means of the turntable 28 of the transport car. The second transport car 27, running in the longitudinal direction of the web-fed rotary printing press, positions the loaded first transport car 16, carrying the prepared roll 24, in front of the selected track 31 of the intermediate storage facility 39 in such a way, that the latter can be run directly onto this track 31. The first transport car 16 carrying the prepared roll 24 is moved now onto the selected track 31 and parked. In this way, first transport cars 16 loaded with prepared rolls 24 can be temporarily stored on a plurality of tracks 31, 32, 33, 34, 36, 37, 38.

In the preferred embodiment represented, the length of a track of the intermediate storage facility 39 is designed to be such that, for example, three first transport cars 16, each loaded with a roll 24, can be parked on a selected track 31, 32, 33, 34, 36, 37, 38. One half ofthe intermediate storage facility 39 has seven tracks 31, 32, 33, 34, 36, 37, 38, each of which can receive three first transport cars 16.

A third transport car 41 is provided for further transport to the roll changers 2. This third transport car 41 can be displaced in the longitudinal direction of the web-fed rotary printing press and has at least two receivers 42, 43, which are arranged next to each other and which extend perpendicularly to the transport direction of the third transport car 41. These receivers 42, 43 which, for example, are designed as rail sections, are spaced apart in such a way that at least one roll remainder 44 of a reduced diameter d44 and a prepared roll 24 with a maximum diameter d24 can be simultaneously received. A distance between the two receivers is understood to be the distance between the two centers of the receivers 42, 43.

This third transport car 41 is positioned in front of an end of a selected track 31, 32, 33, 34, 36, 37, 38 of the intermediate storage facility 39, so that a transport car 16 loaded with a prepared roll 24 can directly move into this third transport car 41. This third transport car 41 now moves to a preselected roll changer 2.

Prior to being transported into the intermediate storage facility 39, each roll 24 is adhesively prepared, i.e. the roll 24, which is being transported from the intermediate storage facility 39 in the direction toward the roll changer 2, has been prepared prior to having been taker out of the intermediate storage facility 39, i.e. it has been provided with adhesives. Thus, a plurality of first transport cars 16 loaded with prepared rolls 24 provided with adhesives is stored in the intermediate storage facility 39. A roll 24 to be supplied to the roll changer can be selected from this intermediate storage facility 39.

It is possible in particular to select a track 31, 32, 33, 34, 36, 37, 38 ofthe intermediate storage facility 39.

All "new" rolls stored in the intermediate storage facility 39 have been prepared prior to being removed and transported to the roll changer.

Figure 3:
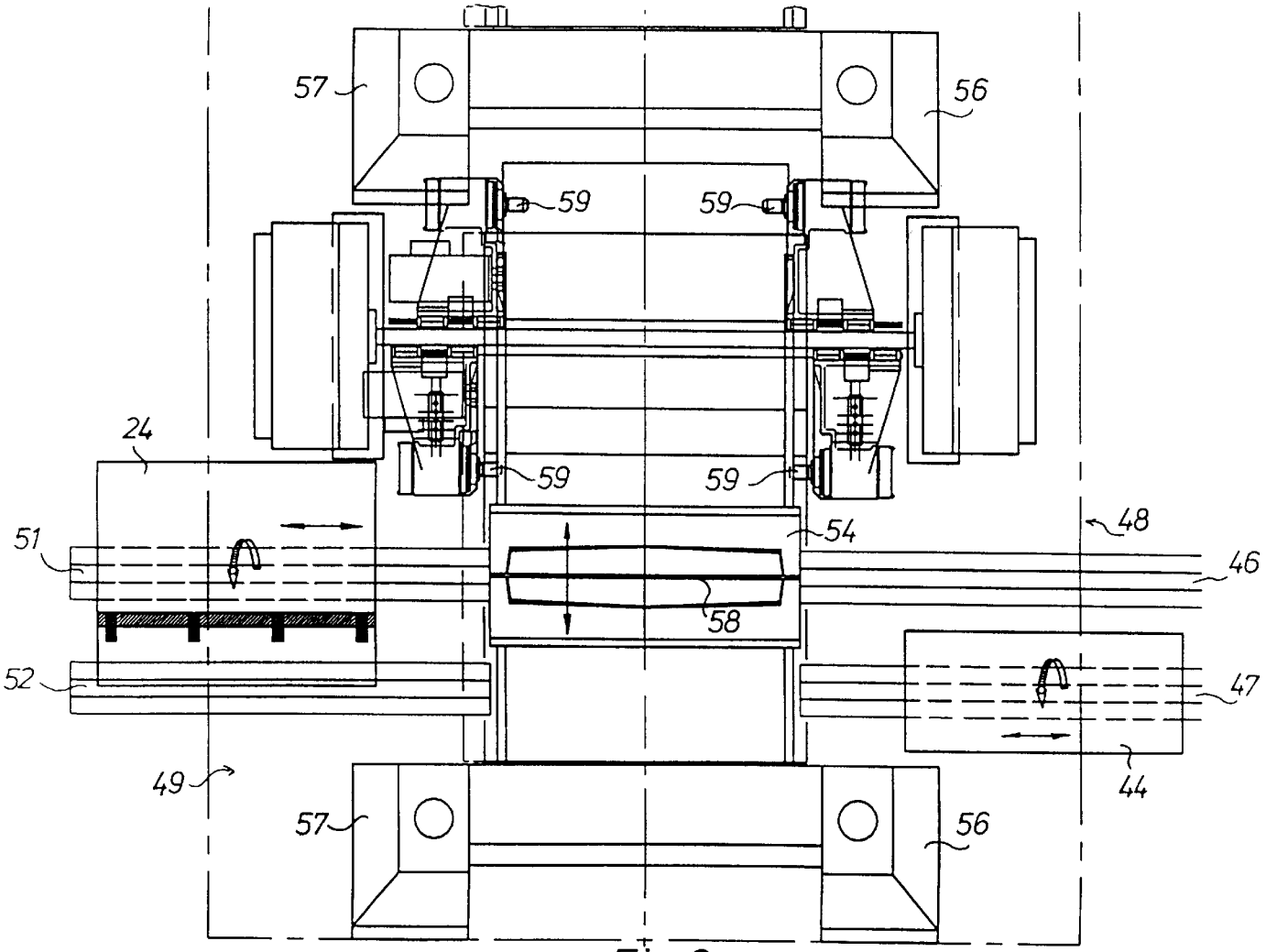
FIG. 3, an enlarged schematic representation of the rails in FIG. 1 arranged in the area of a roll changer.

Two tracks 46, 47, which extend parallel with each other and perpendicular to the longitudinal direction of the web-fed rotary printing press, as seen in FIG. 3, are assigned to each one of these roll changers 2. The track 46 located closest to the respective roll changer 2 is preferably used for receiving the prepared roll 24 to be supplied. These two tracks 46, 47, which lead from a first side 48 of the roll changer 2 facing the intermediate storage facility 39 into the roll changers 2, can also extend, as in the preferred embodiment seen in FIG. 3, past the second side 49 of the roll changer 2 of the web-fed rotary printing press facing away from the intermediate storage facility 39. The extended ends of the tracks 46, 47 can only be used starting at the roll changer 2, i.e. these ends are designed as "blind tracks" 51, 52. As represented in FIG. 3, a transport car 16 with a prepared roll 24 or with a roll remainder 44 can be temporarily stored on these blind tracks 51, 52, which are extended past the lateral frame of the roll changers.

The second track 47 assigned to the roll changer 2 is used for transporting a transport car 16 with a roll remainder 44 of reduced diameter d44 from the roll changer 2 to the third transport car 41, which can be displaced in the longitudinal direction.

This third transport car 41 is positioned in front of the selected roll changer 2 in such a way that the two receivers 42, 43 of the transport car 41 are flush with the two tracks 46, 47 assigned to the roll changer 2. In this way it is possible to load or unload this third transport car 41 from both tracks 46, 47 without changing its position.

The first transport car 16 with the prepared roll 24 is moved from this third transport car 41 onto the track 46 and temporarily stored, or it is directly supplied to the roll changer 2. Another first transport car 16 with an exchanged roll remainder 44 which, for example, has only a roll core 53 or at least a reduced diameter d44, is already in a parked position on the second track 47. During or after the unloading of the first transport car 16 loaded with the prepared roll 24, this first transport car 16 loaded with the exchanged roll remainder 44 is moved back onto the third transport car 41, which can be moved in the longitudinal direction.

Figure 4:
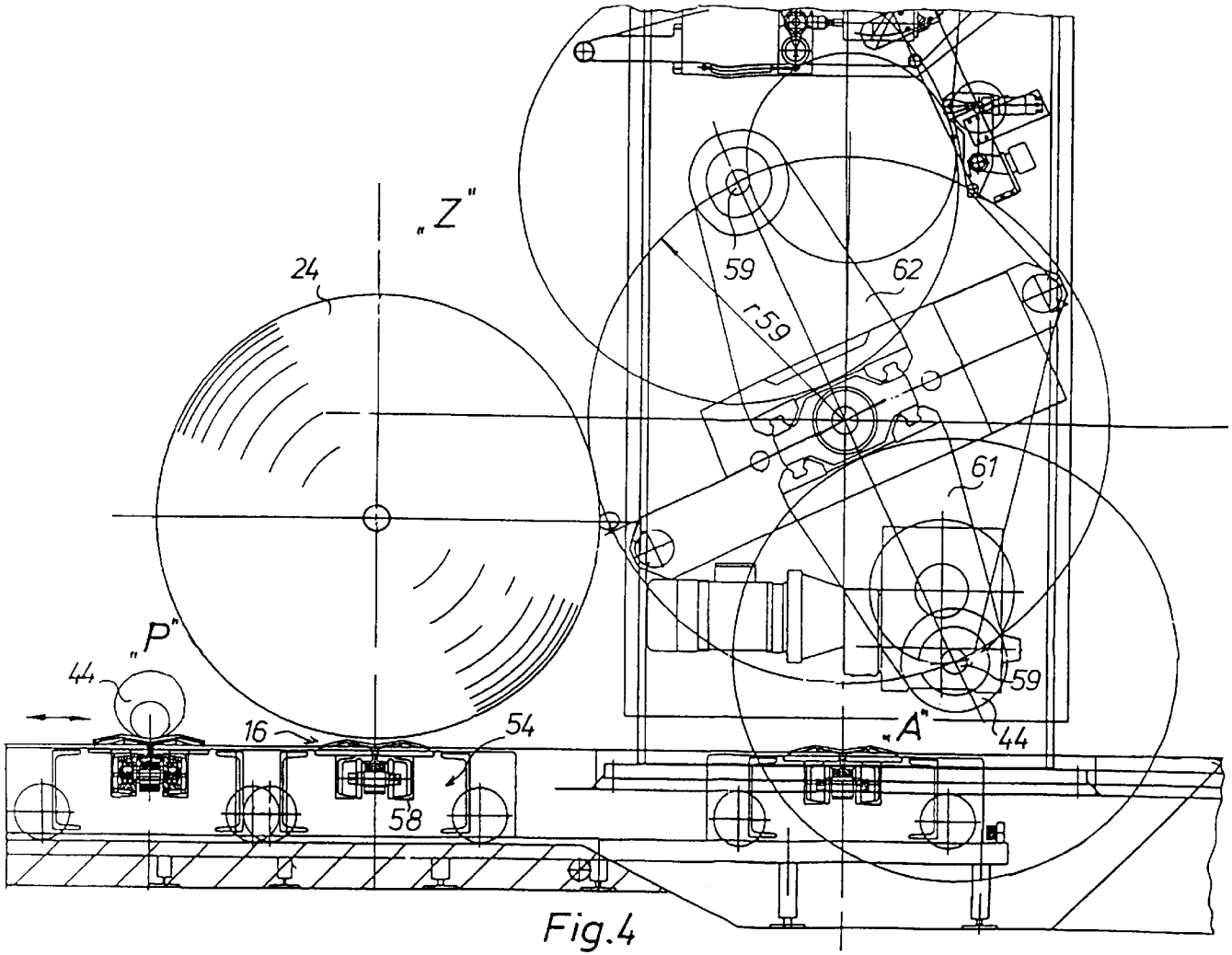
FIG. 4, a schematic lateral view of a roll changer.

For a roll change, the first transport car 16 loaded with a prepared roll 24 moves onto a fourth transport car 54, as seen in FIG. 4, which can be displaced in the longitudinal direction of the web-fed rotary printing press. This fourth transport car 54 can be displaced between lateral frames 56, 57 of the roll changer 2, as seen in FIG. 3, and is arranged below the floor and has a receiver 58. This receiver 58 extends parallel with the two tracks 46, 47, and therefore parallel with an axis defined by clamping cones 59 of the roll changer 2. The fourth transport car 54 can be positioned in such a way that, in a first position, a supply position "Z", as seen in FIG. 4, its receiver 58 works together with the first track 46, in a second position, a parking position "P", with the second track 47, and in a third position, a removal position "A", it stands underneath the support arm 61 with the unwound roll remainder 44. Starting at the supply position "Z", the fourth transport car 54 with the loaded transport car 16 displaces the prepared roll 24 into a changing position. This changing position is a function of a pivot radius 59 of the clamping cones 59 of the roll changer 2 and of the diameter d24 of the prepared roll 24.

In this changing position, the roll 24 located on the two transport cars 54, 16, is grasped by the two clamping cones 59 of a support arm 62 of the roll changer 2, which is two-armed, for example. This support arm 62 pivots upward, together with the grasped roll 24, for the adhesion process.

After the roll changer 2 has grasped the new roll 24 and shifted it off the first transport car 16, which is, in turn, carried by the fourth transport car 54, the longitudinally displaceable fourth transport car 54 moves underneath the second support arm 61, which carries an unwound roll remainder 44. This support arm 61 is placed nearly vertically during the adhesion process of the new roll 24 placed on the first support arm 62, so that a distance between the empty receiver 21 of the first transport car 16 and the unwound roll remainder 44 is minimal, or only slightly larger than the shortest distance. Now the clamping cones 59 of the roll changer 2 release the unwound roll remainder 44. This unwound roll remainder 44 drops on the receiver 21 of the transport car 16.

The fourth transport car 54 loaded with the unwound roll remainder 44 and the transport car 16 moves out of the roll changer 2 into its park position "P". This may be seen in FIG. 4.

During the roll changing process, the third transport car 41, which can be displaced in the longitudinal direction and which is loaded with the transport car 16 carrying the unwound roll remainder 44 from the fourth transport car 54, moves to a selectable track 63, 64, 66 of the intermediate storage facility 39. The third transport car 41 is positioned in front of this selected track 63, 64, 66, so that the loaded first transport car 16 carrying the unwound roll remainder 44 can enter this track 63, 64, 66.

This selected track 63, 64, 66 can be, for example, a track 63, 64 for the temporary storage of the partially unwound roll remainders 44 with the associated first transport car 16. In the preferred embodiment, for example, two of these tracks 63, 64 are provided for the temporary storage and renewed supply to the roll changers 2.

In most cases the third transport car 41 loaded with the unwound roll remainder 44 on the first transport car 16 enters a track, to which an unloading station 67 is assigned, which removes the unwound roll remainder 44 from the first transport car 16.

In the preferred embodiment, this track 66 intended for unloading terminates on the turntable 23 placed in front of the transfer station 13, or respectively 14. The first transport car 16, which is now empty, is moved to this turntable 23 and turned by 90°, so that this transport car 16 can again be loaded.

The transport cars 16, 27, 41, 54, which transport the prepared roll 24, can also be designed as "driverless" transport cars, i.e. as "automated guide vehicles" (AGV).

It is also possible to design these transport cars not for moving below ground, but as trolley conveyors.

While a preferred embodiment of a method for transporting rolls to a roll changer, in accordance with the present invention, has been set forth fully and completely hereinabove, it will be apparent to one of skill in the art that a number of changes in, for example, the structure of the roll changer, the type of web-fed rotary printing press being used, and the like could be made without departing from the true spirit and scope of the present invention which is accordingly to be limited only by the appended claims.

What is claimed is:

1. A method for transporting rolls to a roll changer including:

providing a plurality of first roll transport cars;

providing a roll preparation station;

using said roll preparation station for making a plurality of prepared rolls;

loading each one of said plurality of said prepared rolls onto a first one of said roll transport cars at said roll preparation station;

providing an intermediate storage facility intermediate said roll preparation station and a roll changer;

using each one of said first roll transport cars to transport its one of said plurality of prepared rolls to said intermediate storage facility;

providing a plurality of second roll transport cars intermediate said intermediate storage facility and said roll changer;

locating a plurality of selected storage tracks in said intermediate storage facility;

directing plurality of said first rolltransport cars, each provided with a prepared roll, to selected ones of said selectable tracks in said intermediate storage facility;

withdrawing said first roll transport cars individually from said intermediate storage area and placing them each on one of said second roll transport cars;

transferring each of said first roll transport cars and its supported one of said prepared rolls to said roll changer on said second roll transport car; and unloading said first roll transport car and said prepared roll at said roll changer.

2. The method of claim 1, further including locating said plurality of selectable storage tracks in said intermediate storage facility each extending in a first direction, and conveying said second transport cars in a second direction perpendicular to said first direction.

* * * * *